US005863615A

United States Patent [19]

Ikeda

[11] Patent Number: 5,863,615

[45] Date of Patent: Jan. 26, 1999

[54] PLATING JIG AND PLATING METHOD USING THE PLATING JIG

[75] Inventor: Tomohiro Ikeda, Shizuoka, Japan

[73] Assignee: Yazaki Corporation, Tokyo, Japan

[21] Appl. No.: 742,155

[22] Filed: Oct. 31, 1996

[30] Foreign Application Priority Data

Oct. 31, 1995 [JP] Japan ..... 7-283561
Oct. 25, 1996 [JP] Japan ..... 8-284060

[51] Int. Cl.[6] ..... B05D 1/18

[52] U.S. Cl. ..... 427/430.1; 427/437; 427/438

[58] Field of Search ..... 427/430.1, 437, 427/438

[56] References Cited

U.S. PATENT DOCUMENTS 4,581,260 4/1986 Mawla ..... 427/443.1
4,990,372 2/1991 Sunder et al. ..... 427/237
5,397,604 3/1995 Phillips, III et al. ..... 427/430.1
5,478,597 12/1995 Jörgens ..... 427/236

FOREIGN PATENT DOCUMENTS 56-25919 3/1981 Japan ..... H02G 3/04
58-9025 1/1983 Japan ..... H02G 3/04
60-111322 7/1985 Japan ..... H02G 3/04
4-61413 5/1992 Japan ..... H02G 3/04

*Primary Examiner*—Benjamin Utech
*Attorney, Agent, or Firm*—Sughrue, Mion, Zinn, Macpeak & Seas, PLLC

[57] ABSTRACT

A plating jig for plating a corrugated tube includes a linear center rod, a circular rod helically formed with the center rod as its center axis, support rods each having a base fixed to the center rod and an end extended in the radial direction of the circular rod, and suspensions provided at the ends of the support rods respectively, extended in the same direction as the center rod and connected to the one-end side outer circumferential surface of the circular rod.

4 Claims, 12 Drawing Sheets

PLATING JIG AND PLATING METHOD USING THE PLATING JIG

BACKGROUND OF THE INVENTION

The present invention relates to a plating jig for holding a flexible pipe material having a slit in the lengthwise direction thereof and a plating method using the plating jig and, in particular, relates to a plating jig and a plating method adapted to the case where electroless plating is applied to a long-size corrugated tube formed of a resin material.

In recent years, electronic application to controllers has been developed in the field of cars, machine tools, office machines, etc. Measures counter to electromagnetic wave noise in these electronic appliances have become an important problem. Such electronic appliances require shielding measures for shielding internal conductors of wirings from external electric field because wirings connected to the electronic appliances are apt to absorb electromagnetic wave noise. The shielding of the internal conductors is performed by grounding external conductors covering the internal conductors. One of the external conductors used in this occasion is a shielded-plating corrugated tube obtained by applying plating to a bellows-like pipe material (corrugated tube) having flexibility and formed of a resin material. The shielded-plating corrugated tube is formed so as to have a shielding effect by applying plating to a tube used originally as a wiring protecting material. In the shielded-plating corrugated tube, a slit for inserting wiring therein is formed in the lengthwise direction in the same manner as in the conventional corrugated tube.

For plating the shielded-plating corrugated tube, an electroless plating method is used because the corrugated tube (to be plated) as a base is an electrically insulating material. In the electroless plating method, a material (to be plated) with a catalyst spread on the surface thereof is put into a bath containing a metal ion and a reducing agent, so that a metal coating is formed on the surface of the material (to be plated) by a catalytic reaction. Such electroless plating is classified by plating equipment into a hang-plating method (also called a rack type plating method), a barrel plating method, etc.

In the hang-plating method, as shown in FIGS. 19 and 20, a roll of long-size corrugated tube 3 is put into a resin-coated cage 1 and then a set of the corrugated tube 3 and the cage 1 is put into a plating tank 7 in which a plating solution 5 is stored. In another method, as shown in FIG. 21, short-cut corrugated tubes 3 may be put into a plating tank 7 while hung by a rack 9.

On the other hand, in the barrel plating method, as shown in FIG. 22, a roll of corrugated tube 3 put into a cylindrical wire net cage 11 is put into a plating tank 7, so that plating is performed while rotating or swinging the wire net cage 11.

In the plating method shown in FIG. 20, however, the slit formed in the lengthwise direction of the corrugated tube 3 is not disposed in a predetermined direction. Accordingly, in a portion in which the slit 3*a* is disposed downward as shown in FIG. 23(A), bubbles 13 of air remaining in the corrugated tube 3 without being discharged from the corrugated tube 3 or hydrogen gas or the like, generated in the plating solution remain in the inside in the form of a bubble reservoir, so that the portion does not touch the plating solution. As a result, there arises a problem that portions which are not plated may be generated. Further, in a portion in which the slit 3*a* is disposed upward as shown in FIG. 23(B), when the corrugated tube 3 is pulled up from the plating tank, some plating solution remains in the bottom portion, that is, so-called bailing of the plating solution occurs. As a result, there arises a problem that the remaining plating solution is mixed with the next plating solution so that deterioration of the plating solution makes proper plating impossible. If exchange of the plating solution to a new one is performed frequently in order to prevent the deterioration of the plating solution, production costs increase.

Further, in the plating method shown in FIG. 21, there arises a problem that not only the commercial value thereof is reduced because the corrugated tube 3 is cut into a short length, but also production costs are increased because large scale processing cannot be performed.

Further, in the plating method shown in FIG. 22, the slit 3*a* is not disposed in a predetermined direction in the same manner as in the method shown in FIG. 20. Accordingly, there arises a problem that not only plating failure due to the bubble reservoir and deterioration of the plating solution due to the bailing of the plating solution occur but also corrugated tubes 3 are apt to touch each other so that adhesion of plating in the contact portion is lowered.

SUMMARY OF THE INVENTION

The present invention is designed upon the aforementioned circumstances and has an object to provide a plating jig in which: bubble reserving and plating solution bailing can be prevented; long-size materials can be plated at once; and suitable gaps can be secured to perform stable plating, and to provide a plating method using the plating jig, for reducing production costs efficiency and quality and reduction of producing cost.

To achieve the foregoing object, the configuration of the plating jig according to the present invention is characterized in that the plating jig comprises: a linear center rod; a circular rod formed helically with the center rod as its center axis; support rods each having a base end fixed to the center rod and a tip end extended in the radial direction of the circular rod; and suspensions provided at tip ends of the support rods respectively, extended in the same direction as the center rod and connected to the one-end side outer circumferential surface of the circular rod.

Further, the plating method using the above plating jig according to the present invention is characterized by comprising the steps of: fitting a corrugated tube having a slit formed in the lengthwise direction thereof onto the helical circular rod provided on the outer circumference of the center rod and, at the same time, disposing the slit on the one-end side of the enter rod; putting the corrugated tube mounted on the circular rod into a plating tank while holding the one end side of the center rod and hanging the center rod vertically; changing the support position of the center rod in the plating tank from the one end side to the other end side; and taking the corrugated tube mounted on the circular rod out of the plating tank while holding the other end side of the center rod and hanging the center rod vertically.

In the plating jig configured as described above, the suspensions for supporting the circular rod project toward the one-end side of the center rod in the same direction as the center rod from the circular rod, so that the slit in which the suspensions are inserted is always turned to a predetermined direction, that is, toward the one-end side of the center rod when a corrugated tube is mounted onto the center rod.

Further, in the plating method using the plating jig, when the corrugated tube is put into the plating tank in a state in which the slit is disposed upward, bubbles in the corrugated tube are rapidly discharged to the outside through the opening portions of the slit disposed upward. No bubble standing occurs in the inside of the corrugated tube. When the corrugated tube is taken out of the plating tank in a state in which the plating jig is turned upside down so that the slit is disposed downward, the plating solution in the corrugated tube is rapidly discharged to the outside through the slit disposed downward. Thus, bailing of the plating solution is avoided.

DETAILED DESCRIPTION OF THE INVENTION

Preferred embodiments of a plating jig and a plating method using the plating jig according to the present invention will be described below in detail with reference to the drawings.

Figure 1:
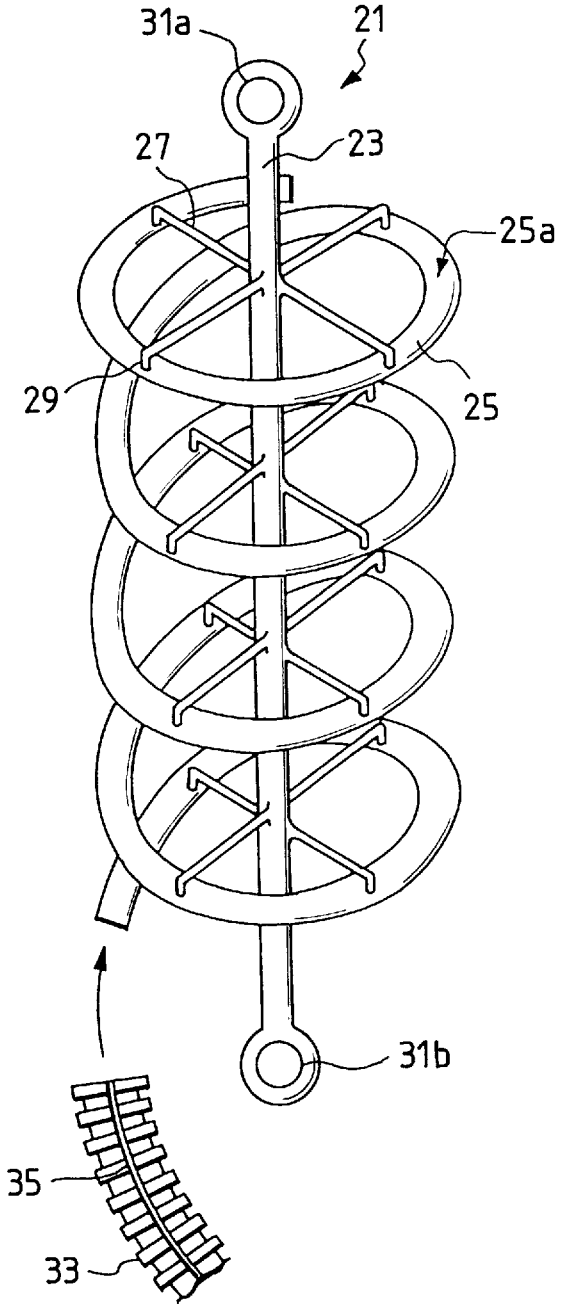
FIG. 1 is a perspective view showing a plating jig according to the present invention.

FIG. 1 is a perspective view showing a plating jig according to the present invention.

The plating jig 21 has a linear center rod 23, and a helical circular rod 25 disposed helically with the center rod 23 as its center axis. Respective base ends of support rods 27 extended in the radial direction of the circular rod 25 are fixed to the center rod 23. The support rods 27 are disposed in a plurality of positions radially with the center rod 23 as their center. Suspensions 29 bent in the same direction as the center rod 23 are formed at tip ends of the support rods 27 respectively. Tip ends of the suspensions 29 are joined to a one-end-side outer circumferential surface 25*a* of the circular rod 25. That is, the circular rod 25 is supported by the support rods 27 through the suspensions 29.

Accordingly, in a state in which the center rod 23 is disposed vertically, the suspensions 29 are disposed also vertically so as to be erected (as shown in FIG. 1) or hung from the circular rod 25.

Hanging portions 31*a* and 31*b* are provided at opposite ends, respectively, of the center rod 23 so that the plating jig 21 is hung while one end side or the other end side of the center rod 23 is held by either of the hanging portions 31*a* and 31*b*. A metal such as soft iron, stainless steel, or titanium is used for the skeleton portion of the center rod 23, circular rod 25, support rods 27 and suspensions 29. The surface of the metal is coated with an electrically insulating material. Soft vinyl chloride, polyethylene, celluloid, fluororesin, hard rubber, or the like, is used as the coating material.

Figure 2:
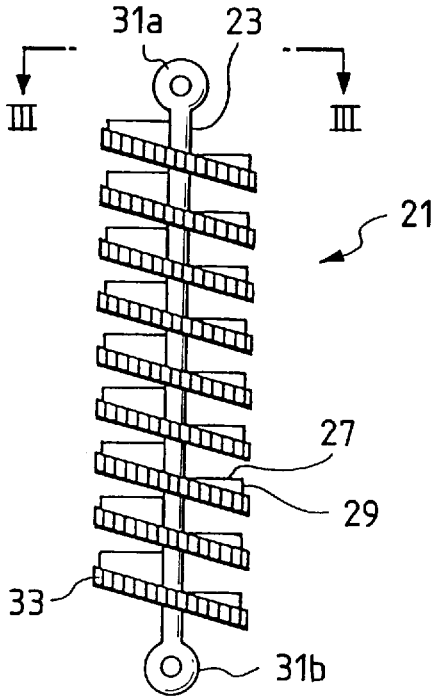
FIG. 2 is a side view showing a state in which a corrugated tube is attached to the plating jig according to the present invention.
Figure 3:
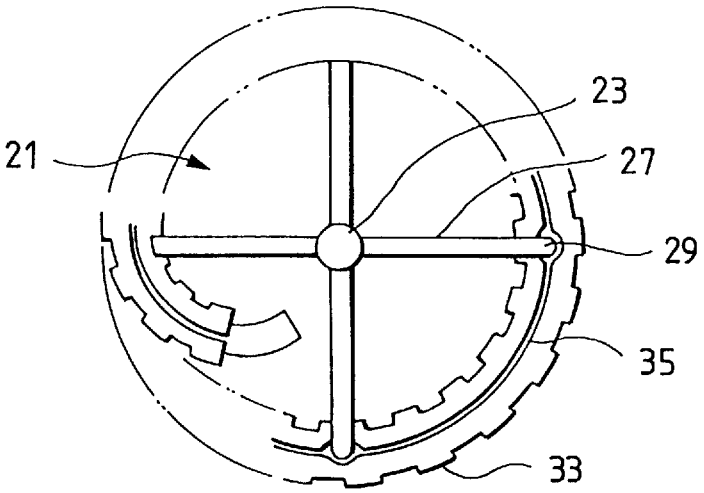
FIG. 3 is a view seen from arrows III—III in FIG. 2.
Figure 4:
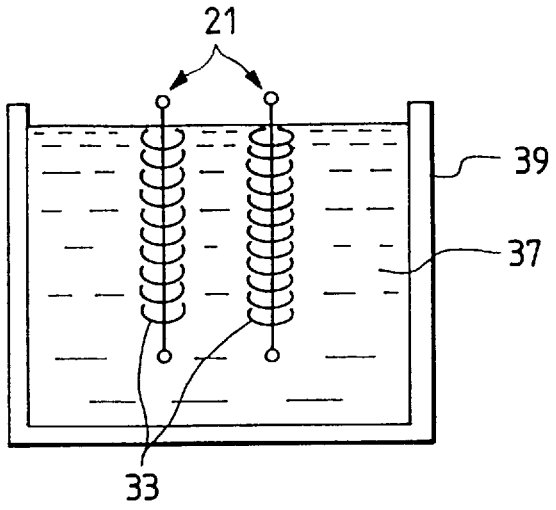
FIG. 4 is a side view showing a state in which plating jigs with corrugated tubes attached thereto are put into a plating tank.
Figure 5:
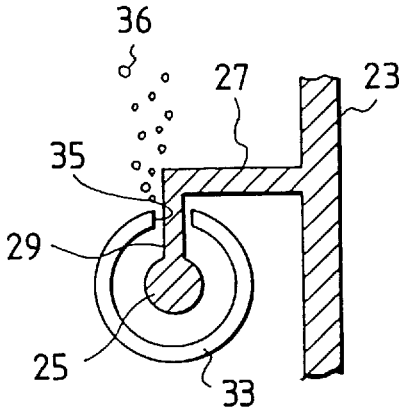
FIG. 5 is a partly sectional view showing a state in which a plating jig with a corrugated tube attached thereto is taken into a plating tank.
Figure 6:
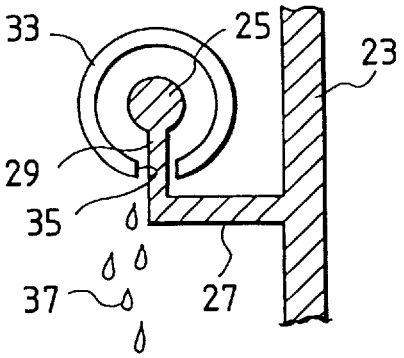
FIG. 6 is a partly sectional view showing a state in which the plating jig with the corrugated tube attached thereto is taken out of the plating tank.

A plating method using the plating jig 21 configured as described above will be described with reference to FIGS. 2 through 6. FIG. 2 is a side view showing a state in which a corrugated tube is mounted to the plating jig according to the present invention; FIG. 3 is a view seen from arrows III—III of FIG. 2; FIG. 4 is a side view showing a state in which the plating jig with the corrugated tube mounted is put in a plating tank; FIG. 5 is a partly sectional view showing a state in which the plating jig with the corrugated tube mounted is taken into the plating tank; FIG. 6 is a partly sectional view showing a state in which the plating jig with the corrugated tube mounted is taken out of the plating tank; and FIGS. 7(A) to 7(I) are explanatory views showing a working procedure for electroless plating.

To mount the corrugated tube 33 to the plating jig 21, the corrugated tube 33 is set onto the circular rod 25 from an end portion of the circular rod 25. The setting of the corrugated tube 33 is performed while the suspensions 29 connecting the support rods 27 to the circular rod 25 are made to pass through a slit 35 of the corrugated tube 33. Accordingly, the corrugated tube 33 mounted on the circular rod 25 over its whole length is disposed so that all the slit 35 faces one end side (upper side in FIG. 2) of the center rod 23. By this way, when the center rod 23 is disposed vertically, the slit 35 is disposed upward or downward in a state in which it is inserted in the circular rod 25.

When, for example, the circular rod 25 of the plating jig 21 has a 50 cm diameter and 100 turns, a corrugate tube 33 with a whole length of 150 m can be mounted. When, for example, the circular rod 25 has a 100 cm diameter and 100 turns, a corrugate tube 33 with a whole length of about 314 m can be mounted.

Then, a plurality of plating jigs 21 each having such a corrugated tube 33 mounted thereon are put in a plating tank 39 having a plating solution 37 stored therein as shown in FIG. 4. To put the respective plating jig 21 into the plating tank 39, one hanging portion 31*a* is held so that the suspensions 29 are hung as shown in FIG. 5, that is, the slit 35 of the corrugated tube 33 is disposed upward.

Further, to take the plating jig 21 out of the plating tank 39 after the completion of immersion for a predetermined time, the center rod 23 is turned upside down and the other hanging portion 31*b* is held so that the suspensions 29 are erected as shown in FIG. 6, that is, the slit 35 of the corrugated tube 33 is disposed downward.

In electroless plating, the plating jig 21 is repeatedly taken in and out of a plurality of plating tanks 39 containing different plating solutions 37 by the aforementioned operation to thereby perform plating. For example, in the case of a corrugated tube 33 of ABS resin, the plating procedure is carried out by steps as shown in FIGS. 7(A) to 7(I). That is, etching is performed by dissolving butadiene on ABS resin to form impressions (FIG. 7(A)), then neutralization of an etching solution (FIG. 7(B)) and cleaner conditioning based on immersion in weak acid (FIG. 7(C)) are performed. After pre-dipping is then performed (FIG. 7(D)), immersion in a catalyst solution is performed to precipitate a colloidal substance of palladium and tin on the surface (FIG. 7(E)), and then activation, that is, immersion in an accelerator solution is performed to remove tin and leave only palladium (FIG. 7(F)). After electroless copper plating is then performed (FIG. 7(G)), adsorption of catalyst (palladium chloride) is performed (FIG. 7(H)). Finally, electroless nickel plating is performed (FIG. 7(I)), and then plating is completed after drying. Incidentally, washing and collecting steps are put between the respective steps.

Figure 7A:
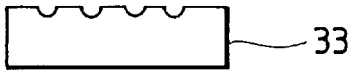
FIGS. 7(A), 7(B), 7(C), 7(D), 7(E), 7(F), 7(G), 7(H), and 7(I) are explanatory views showing a working procedure for electroless plating.
Figure 7B:
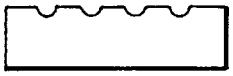
Figure 7C:
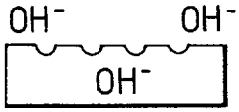
Figure 7D:
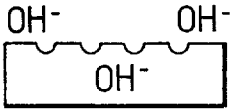
Figure 7E:
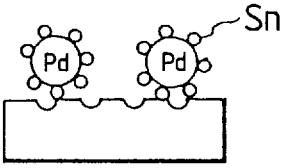
Figure 7F:
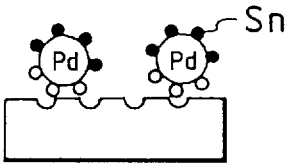
Figure 7G:
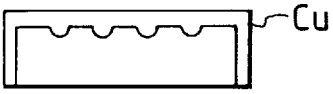
Figure 7H:
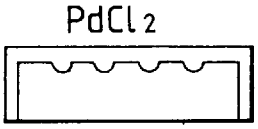
Figure 7I:
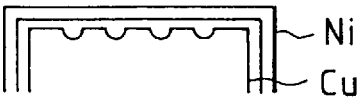

In the aforementioned steps, especially in etching (FIG. 7(A)) and electroless copper plating (FIG. 7(G)), there is a tendency that bubbles of hydrogen gas or the like, are generated easily. At least in these steps, essential is the inverting operation of turning the aforementioned center rod 23 upside down, that is, inverting the position of the slit 35 vertically when the plating jig 21 is taken in and out of the plating tanks 39.

By the aforementioned electroless copper/nickel plating, copper undercoat plating (0.8 to 1.6 $\mu$m) for electromagnetic shielding is formed on the front and rear surfaces of the corrugated tube 33, and nickel plating (0.25 $\mu$m) for corrosion prevention is formed thereon to thereby make it possible to obtain a shielded-plating corrugated tube having a shielding effect of sufficient practical performance.

The action of the plating method using the plating jig 21 will be described below.

In the plating jig 21, the slit 35 through which the suspensions 29 pass is always turned to a predetermined direction, that is, to the one-end side of the center rod 23 when the corrugated tube 33 is mounted onto the circular rod 25 because the suspensions 29 for supporting the circular rod 25 project toward the one-end side of the center rod 23 in the same direction as the center rod 23 from the circular rod 25. Accordingly, the slit 35 are always opened upward or downward in the vertical direction when the center rod 23 is disposed in the vertical direction.

Further, portions of the slit 35 into which the suspensions 29 are inserted are forcedly spread by the suspensions 29 so as to be widely opened. Further, the corrugated tube 33 grips the suspensions 29 on the basis of restoring force generated by the slit 35 forcedly spread by insertion of the suspensions 29 into the slit 35, by which the corrugated tube 33 is prevented from dropping out from the circular rod 25. That is, the suspensions 29 serve to limit the position of the slit 35 and also to limit the dropping-out of the corrugated tube 33.

When the corrugated tube 33 is then taken into the plating tank 39 in a state in which the slit 35 is disposed upward as shown in FIG. 5, bubbles 36 of inside air, generated gas, and so on, are rapidly discharged to the outside through the opening portion of the slit 35 disposed upward. As a result, no bubble standing occurs in the inside.

Further, when the corrugated tube 33 is taken out of the plating tank 39 in a state in which the plating jig 21 is turned upside down so that the slit 35 is disposed downward as shown in FIG. 6, the plating solution 37 in the inside of the corrugated tube 33 is rapidly discharged to the outside through the slit 35 disposed downward. As a result, the plating solution 37 thus bailed is never mixed with another plating solution 37 of the next plating tank 39.

According to the plating method using the plating jig 21 as described above, because the helical circular rod 25 is provided round the center rod 23 and supported through the suspensions 29 disposed in the same direction as the center rod 23, the corrugated tube 33 can be attached to the plating jig 21 in a state in which the slit 35 is turned to the one-end side of the center rod 23, by mounting the corrugated tube 33 onto the circular rod 25 while inserting the suspensions 29 into the slit 35. Accordingly, the slit 35 of the corrugated tube 33 can be disposed upward or downward by holding one end side or the other end side of the center rod 23. As a result, not only discharge of bubbles can be performed very well in the plating solution 37 but also discharge of the plating solution 37 can be performed very well when the corrugated tube 33 is taken out of the plating tank 39.

Further, because the circular rod 25 is formed helically, long corrugated tubes 33 can be subjected to plating at once. Accordingly, producing efficiency is improved without reduction of commercial value, so that producing cost can be reduced.

Further, because bubbles are discharged from the corrugated tube 33 so that no bubble standing occurs, plating can be stabilized so that good coatings can be obtained.

Further, in electroless plating in which plating solutions must be exchanged by ten and several times, any plating solution 37 can be discharged rapidly from the corrugated tube 33 if the aforementioned plating jig 21 is used. Accordingly, when plating tanks 39 are exchanged, a plating solution 37 in the current step is prevented from being mixed with another plating solution 37 in a plating tank 39 in the next step. Accordingly, not only deterioration of such plating solutions 37 is suppressed but also the number of times for exchange of solutions in plating tanks 39 is reduced. As a result, producing cost can be also reduced.

Figure 8:
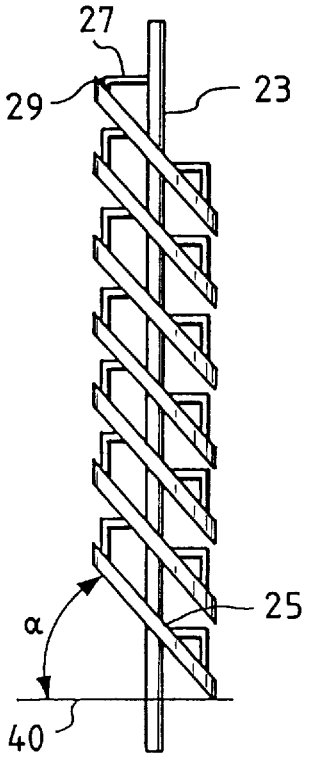
FIG. 8 is a side view showing a modified example of the plating jig in which the inclination angle of the circular rod is selected to be large.

Incidentally, the aforementioned plating jig 21 is designed so that bubbles or plating solutions 37 are discharged well by disposing the slit 35 upward or downward. If the inclination angle (the angle between the circular rod 25 and a horizontal virtual line 40 in a state in which the center rod 23 is disposed vertically) $\alpha$ of the circular rod 25 is selected to be large (for example, $\alpha>45°$) as shown in FIG. 8, discharge of bubbles and plating solutions 37 from opposite end portions of the corrugated tube 33 is accelerated so that characteristic of discharge of bubbles and plating solutions can be improved more greatly in cooperation with the aforementioned action of discharge from the slit 35.

Figure 9:
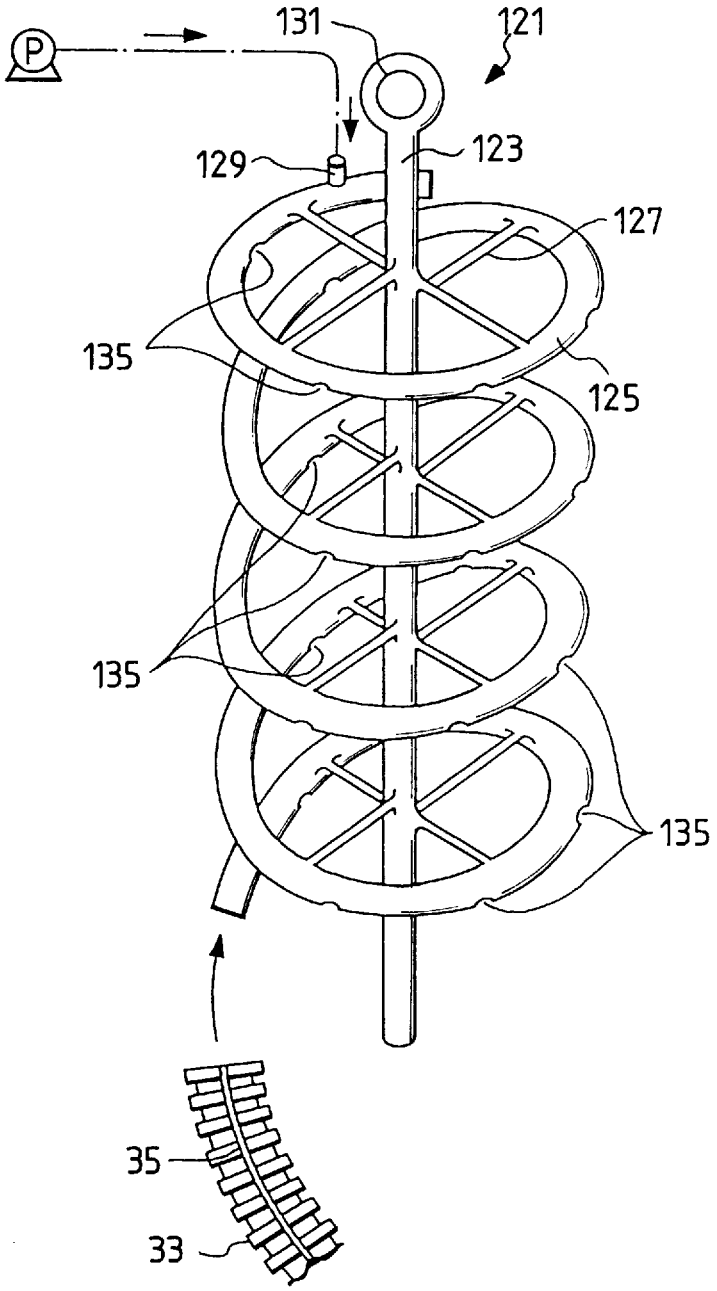
FIG. 9 is a perspective view showing another embodiment of the plating jig according to the present invention.

Another embodiment of the plating jig according to the present invention will be described below with reference to FIG. 9. FIG. 9 is a perspective view showing the plating jig in another embodiment.

This plating jig 121 has a linear center rod 123, and a circular rod 125 disposed helically with the center rod 123 as its center axis. Respective base ends of support rods 127 extended in the radial direction of the circular rod 125 are fixed to the center rod 123. The support rods 127 are disposed in a plurality of portions radially with the center rod 123 as their center. Tip ends of the support rods 127 are joined to the inner circumferential surface of the circular rod 125. That is, the circular rod 125 is supported by the support rods 127 and integrated with the center rod 123.

The circular rod 125 is formed from a pipe material having opposite ends closed. A connection port 129 is provided near one end of the circular rod 125 so that means for circulating a plating solution or cleaning water or a fluid supplying means (pump) P which is an air blowing means can be connected to the connection port 129.

Further, a plurality of discharge holes 135 are formed in the circular rod 125. In this embodiment, the discharge holes 135 are opened in the lower surface which is the other end side of the center rod 123. Accordingly, a plating solution or air supplied to the connection port 129 is introduced to the hollow portion of the circular rod 125 and discharged to the inside of the corrugated tube 33 mounted on the circular rod 125.

A hanging portion 131 is provided at one end of the center rod 123 so that one end side of the center rod 123 is held by the hanging portion 131 to thereby hang the plating jig 121. A metal such as soft iron, stainless steel, titanium is used for the skeleton portion of the center rod 123, circular rod 125 and support rods 127. The surface of the metal is coated with an electrically insulating material. As the coating material, soft vinyl chloride, polyethylene, celluloid, fluororesin, hard rubber, or the like, is used.

Figure 10:
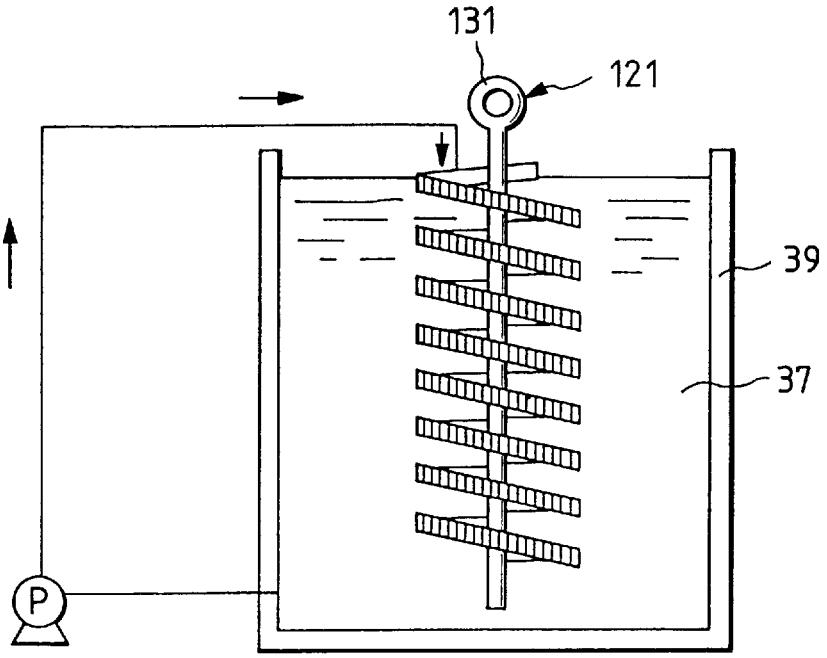
FIG. 10 is a side view showing a state in which the plating jig with a corrugated tube attached thereto is put in a plating tank.
Figure 11:
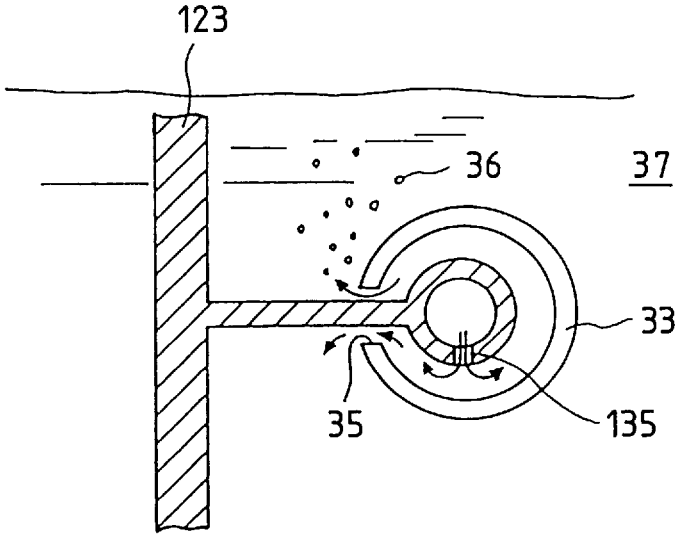
FIG. 11 is a partly sectional view showing a state in which the plating jig with the corrugated tube attached thereto is taken into the plating tank.

A plating method using the plating jig 121 configured as described above will be described with reference to FIGS. 10 and 11. FIG. 10 is a side view showing a state in which a plating jig with a corrugated tube attached thereto is put in a plating tank; and FIG. 11 is a partly sectional view showing a state in which the plating jig with the corrugated tube attached thereto is taken into the plating tank.

To mount the corrugated tube 33 to the plating jig 121, the corrugated tube 33 is set onto the circular rod 125 from an end portion of the circular rod 125. The setting of the corrugated tube 33 is performed by fitting the corrugated tube 33 onto the circular rod 125 while the support rods 127 for supporting the circular rod 125 are made to pass through a slit 35 of the corrugated tube 33. In an immersion step in the plating tank 39, the plating jig 121 with the corrugated tube 33 attached thereto is put into the plating tank 39 in which a plating solution 37 is stored as shown in FIG. 10 in a state in which the hanging portion 131 is held.

It is designed that the plating solution 37 in the plating tank 39 can be supplied to the plating jig 121 through a pump P. When the pump P is operated, the plating solution 37 is supplied into the circular rod 125 through the connection port 129 and discharged from the discharge holes 135 of the circular rod 125 into the corrugated tube 33 as shown in FIG. 11. As a result, bubbles 36 remaining in the corrugated tube 33 are forcedly and rapidly discharged to the outside from gaps between the slit 35 of the corrugated tube 33 and the support rods 127 or from a terminal end of the corrugated tube 33 so that the corrugated tube 33 is filled with the plating solution 37.

Then, in the case where treatment using another plating tank or cleaning tank not shown is to be performed, the plating jig 121 is pulled up from the plating tank 39 by the hanging portion 131. As a result, the plating solution 37 flows down in the corrugated tube 33 and is discharged from the lower end of the corrugated tube 33. Further, at the point of time when this discharge is nearly interrupted, the pump P is operated to feed dry air forcedly to the plating jig 121. As a result, the plating solution 37 remaining in the corrugated tube 33 is forcedly discharged. That is, the plating solution 37 remaining in the corrugated tube 33 is rapidly discharged so that not only mixing/flowing-out of another plating solution 37 in the next step is prevented but also the time of shifting to the next step is shortened.

After completion of washing the corrugated tube 33, dry air is forcedly fed to the plating jig 121 hung vertically by holding the hanging portion 131 in the same manner as described above. The dry air jetted from the discharge holes 135 discharges the cleaning solution remaining in the corrugated tube 33 to the outside and discharges wet air from the slit 35 and the lower end of the corrugated tube 33 to dry the inside of the corrugated tube 35.

According to the plating jig 121 as described above, because the plating solution or air is discharged from the discharge holes 135 so that bubble standing or remaining water is forcedly discharged, the position of the slit 35 need not be inverted by supporting the plating jig upside down when the plating jig is taken in and out of the plating tank 39 as described above in the previous embodiment. Accordingly, the plating jig 121 is easily adapted to automation. Incidentally, if the circular rod for discharging the plating solution or air is applied to the previous plating jig in which the slit position of the corrugated tube is located in the upper/lower end side and the upper and lower positions are inverted in operation, bubble standing or plating solution remaining in the corrugated tube can be discharged more effectively.

Figure 12:
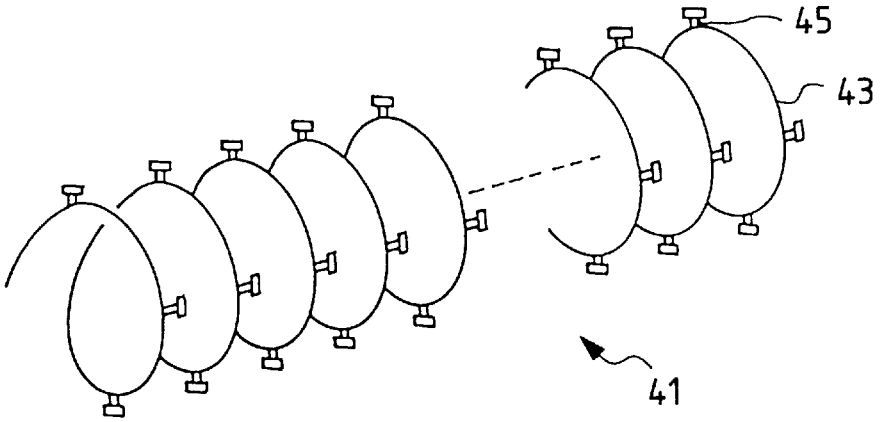
FIG. 12 is a perspective view showing a further embodiment of the plating jig according to the present invention.
Figure 13:
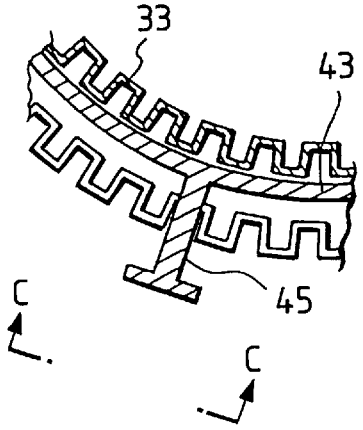
FIG. 13 is a partly sectional view of the plating jig depicted in FIG. 12.
Figure 14:
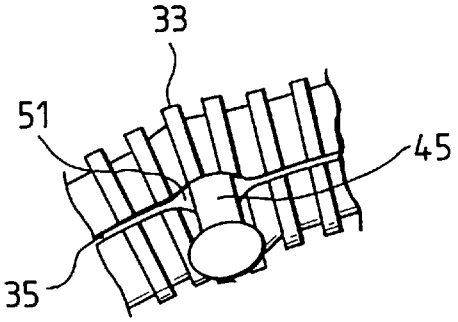
FIG. 14 is a view seen from arrows C—C in FIG. 13.

A further embodiment of the plating jig according to the present invention will be described below with reference to FIGS. 12 through 14. FIG. 12 is a perspective view showing the plating jig in a further embodiment; FIG. 13 is a partly sectional view of the plating jig depicted in FIG. 12; and FIG. 14 is a view seen from arrows C—C in FIG. 13.

This plating jig 41 has a base formed of a helical circular rod 43. A plurality of (four in this embodiment) open rods 45 projecting out in the radial direction of the circular rod 43 are provided at regular intervals on the outer circumference of the circular rod 43. The open rods 45 are made to pass through a slit 35 of a corrugated tube 35 mounted on the circular rod 43 as shown in FIGS. 13 and 14. As a result, not only portions of the slit 35 in which the open rods 45 are inserted are opened as shown in FIG. 14 but also the portions of the slit 35 are disposed in the radially outside of the outer circumference of the circular rod 43.

Figure 15:
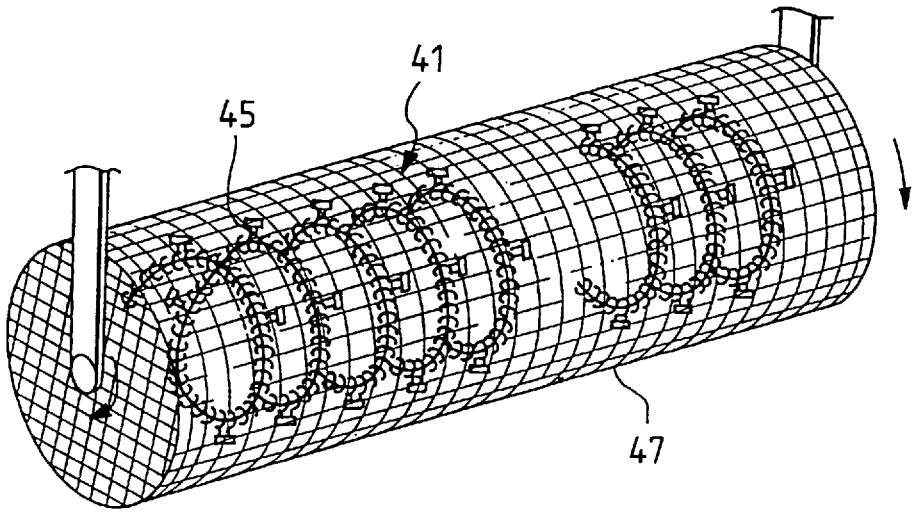
FIG. 15 is a perspective view showing a further embodiment of the plating jig used in a barrel plating method.

A plating method using the plating jig 41 configured as described above will be described with reference to FIG. 15. FIG. 15 is a perspective view showing the plating jig according to a further embodiment used in a barrel plating method.

To attach the corrugated tube 33 to the plating jig 41, the corrugated tube 33 is fitted onto the circular rod 43 from an end portion of the circular rod 43 while the open rods 45 are made to pass through the slit 35. Accordingly, the corrugated tube 33 mounted on the whole length of the circular rod 43 is disposed so that the whole slit 35 is disposed in the radially outside of the circular rod 43.

Then, the plating jig 41 with the corrugated tube 33 attached thereto is put into a wire net cage 47 of a barrel plating apparatus. The center axis of the wire net cage 47 is supported horizontally so that the wire net cage 47 is turned around the center axis. Accordingly, by rotating the wire net cage 47, the plating jig 41 put in the wire net cage 47 is rotated in the same direction as the wire net cage 47 because the respective ends of the open rods 45 are brought into contact with the inner surface of the wire net cage 47. In this occasion, the corrugated tube 33 never directly touches the inner surface of the wire net cage 47.

In the action based on the plating jig 41, the corrugated tube 33 is mounted onto the helical circular rod 43 so that the corrugated tube 33 is shaped helically. Further, the plating jig 41 is rotated in the wire net cage 47 to thereby exchange the plating solution 37 in the corrugated tube 33 to a new one through the slit 35. As a result, the component proportion of the plating solution 37 in the corrugated tube 33 is stabilized.

Further, because the distance between adjacent corrugated tubes 33 is kept constant by mounting the corrugated tubes 33 on helical circular rods 43 respectively, the corrugated tubes 33 are prevented from touching each other. Further, because the open rods 45 project out radially, the slit 35 fitted onto the open rods 45 is disposed in the outer circumference side of the circular rod 43. Accordingly, when the plating jig 41 put in the wire net cage 47 is disposed horizontally, bubbles in the solution are discharged from the slit 35 disposed upward. Further, when the plating jig 41 is taken out of the plating tank 39, the plating solution 37 is discharged from the slit 35 disposed downward.

In this occasion, the gaps 51 (see FIG. 14) of the slit 35 forcedly spread compared with the ordinary portion of the slit 35 by insertion of the open rods 45 accelerate the bubble escaping/solution escaping function more greatly. Further, when the plating jig 41 is rotated in the wire net cage 47, the open rods 45 are brought into contact with the inner surface of the wire net cage 47 to thereby prevent the collision of the corrugated tube 33 with the wire net cage 47. Accordingly, the open rods 45 serve not only to prevent the injury of the corrugated tube 33 but also to prevent the escaping of the corrugated tube 33 from the circular rod 43.

According to the plating jig 41, not only discharge of bubbles and discharge of the plating solution 37 can be made well to obtain good coatings but also bailing of the plating solution 37 can be prevented so that improvement of quality and producing efficiency and reduction of producing cost can be achieved in the same manner as in the aforementioned plating jig 21. In addition, because the plating jig 41 is rotated around the horizontal axis in a state in which the slit 35 is disposed on the outer circumference of the circular rod 43, the plating solution 37 can be exchanged to a new one to thereby stabilize the plating solution 37 and obtain good coatings. Further, because ends of the open rods 45 projecting out from the circular rod 43 are brought into contact with the wire net cage 47, the corrugated tube 33 can be prevented from directly touching the wire net cage 47 so as to be prevented from being damaged.

Figure 16:
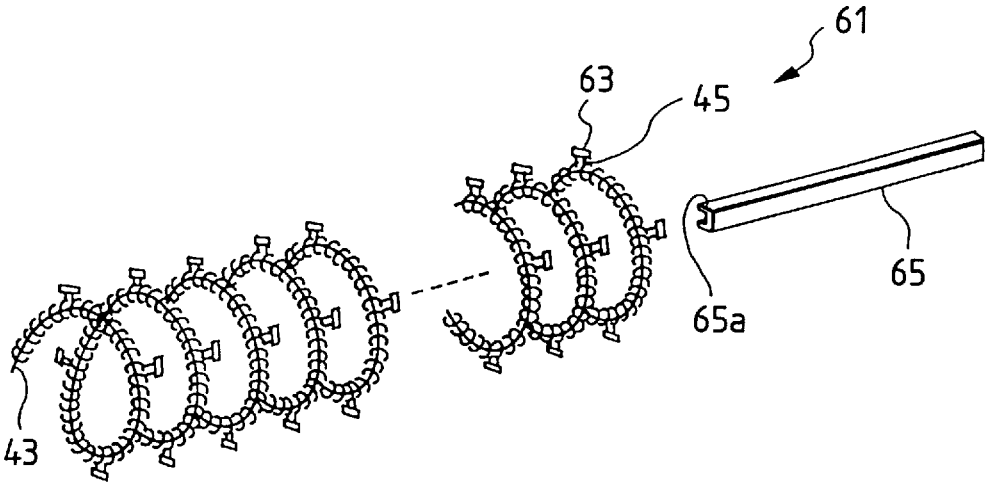
FIG. 16 is an exploded perspective view showing a modified example of the plating jig used in the barrel plating method.
Figure 17:
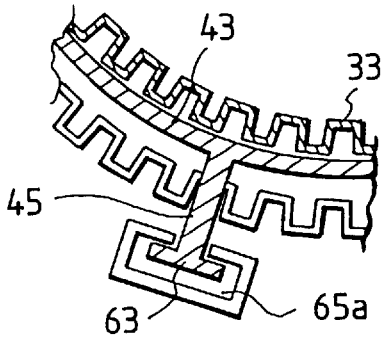
FIG. 17 is a partly sectional view of the plating jig depicted in FIG. 16.
Figure 18:
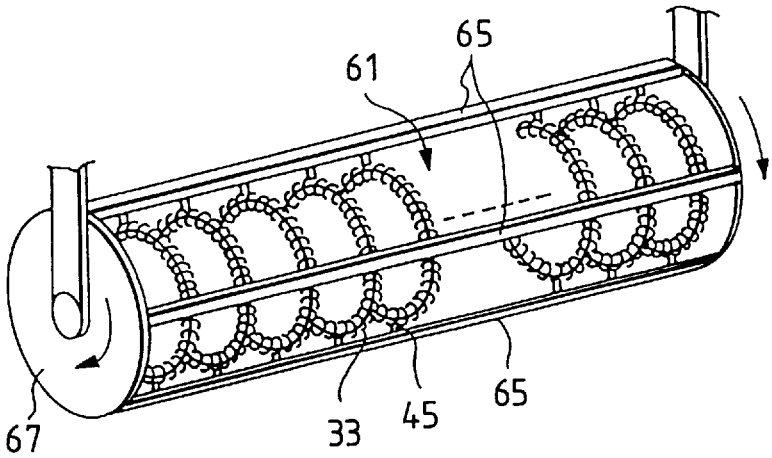
FIG. 18 is a perspective view showing a state in which the plating jig depicted in FIG. 16 is attached to the barrel plating apparatus.
Figure 19:
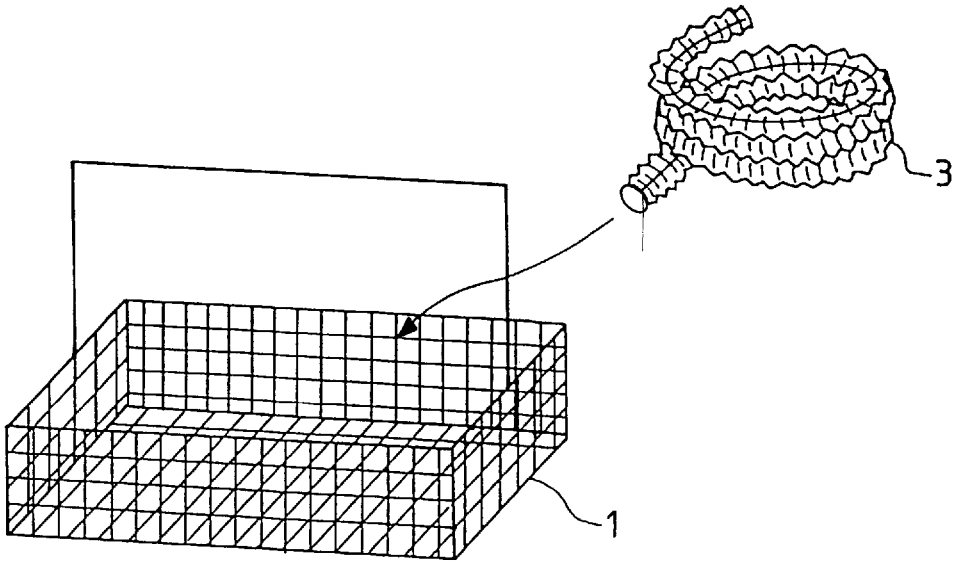
FIG. 19 PRIOR ART
FIG. 19 is a view for explaining a conventional plating method using a hanging plating method.
Figure 20:
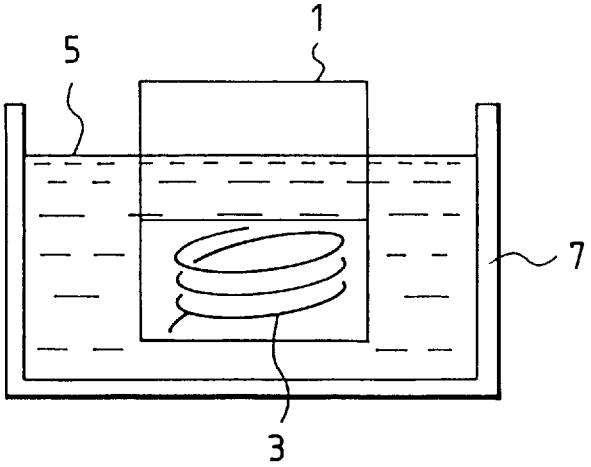
FIG. 20 PRIOR ART
FIG. 20 is a view for explaining the conventional plating method using the hanging plating method.
Figure 21:
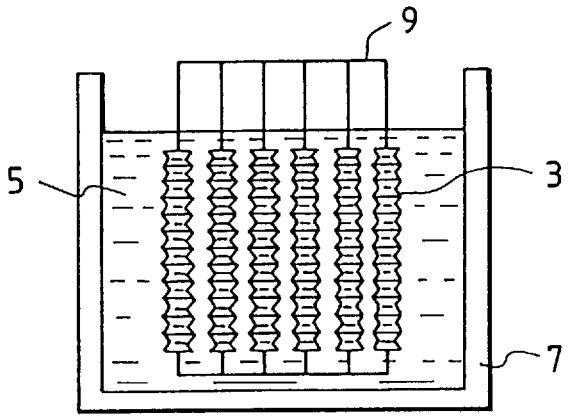
FIG. 21 PRIOR ART
FIG. 21 is a view for explaining a conventional plating method in which short-size corrugated tubes are hung by a rack.
Figure 22:
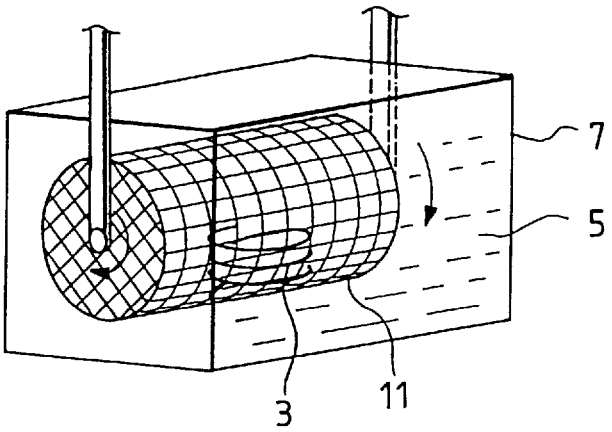
FIG. 22 PRIOR ART
FIG. 22 is a view for explaining a conventional plating method using a barrel plating method.
Figure 23A:
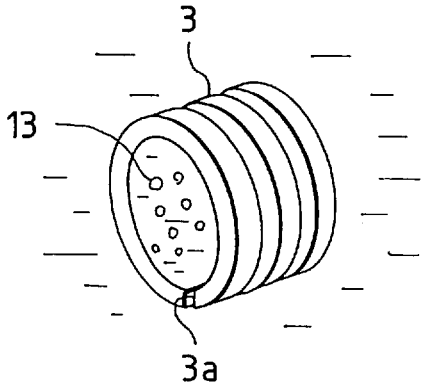
FIG. 23(A) PRIOR ART
FIGS. 23(A) and 23(B) are views for explaining the disadvantage of a slit disposed upward or downward in the conventional plating method.
Figure 23B:
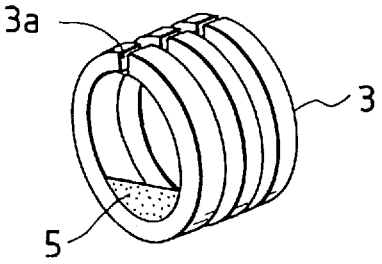
FIG. 23(B) PRIOR ART

A modified example of the plating jig used in the barrel plating method will be described below with reference to FIGS. 16 through 18. FIG. 16 is an exploded perspective view showing the modified example of the plating jig used in the barrel plating method; FIG. 17 is a partly sectional view of the plating jig depicted in FIG. 16; and FIG. 18 is a perspective view showing a state in which the plating jig depicted in FIG. 16 is attached to a barrel plating apparatus.

In this plating jig 61, the circular rod 43 and open rods 45 are formed in the same manner as in the aforementioned plating jig 41. Further, the open rods 45 are provided in the same circumferential positions of the circular rod 43 so as to be arranged on lines in the same direction as the center axis of the circular rod 43. Small flange portions 63 are provided at ends of the open rods 45 respectively. The open rods 45 are designed so that sectionally C-shaped fixture rods 65 are attached to ends of the open rods 45 by engaging groove portions 65*a* with the small flange portions 63.

The plurality of fixture rods 65 attached to the outer circumference of the circular rod 43 through the open rods 45 are designed so that opposite ends of the fixture rods 65 are detachably fixed to portions of rotation plates 67 of the barrel plating apparatus. Accordingly, the plating jig 61 is designed so as to be taken into and out of the plating tank 39 by supporting the fixture rods 65 directly by means of the rotation plates 67 without use of the wire net cage 47.

According to the plating jig 61, in addition to the effects of the aforementioned plating jig 41, not only the necessity of the wire net cage 47 is eliminated but also the corrugated tube 33 can be brought into direct contact with the plating solution 37 without interposition of the wire net cage 47. Accordingly, exchange of the plating solution 37 touching the corrugated tube 33 to a new one can be accelerated. Further, bubbles once discharged from the slit 35 can be prevented from being deposited on the wire net cage 47 and re-deposited on the corrugated tube 33 by the rotation of the wire net cage 47.

As described above in detail, in the plating jig according to the present invention, a helical circular rod is provided round a center rod and supported through suspensions disposed in the same direction as the center rod. Accordingly, by mounting a corrugated tube onto the circular rod while the suspensions are made to pass through a slit, the corrugated tube can be attached to the plating jig in a state the slit is turned to the one-end side of the center rod. As a result, the slit of the corrugated tube can be disposed upward or downward by holding the one-end or other-end side of the center rod. Further, because the circular rod is formed helically, long-size corrugated tubes can be subjected to plating at once. Accordingly, producing efficiency is improved without reduction of commercial value, so that producing cost can be reduced.

Further, in the plating method using the plating jig according to the present invention, discharge of bubbles in the plating solution and discharge of the plating solution at the time of taking of the plating jig out of the plating tank can be made very well. Accordingly, not only no bubble standing remains so that good coatings can be obtained but also mixing of the plating solution with another plating solution in the next plating tank is prevented to thereby reduce deterioration of the plating solution. Accordingly, the number of times for exchange of plating solutions in plating tanks is reduced, so that producing cost can be reduced.

Further, in the plating jig according to the present invention, a hollow circular rod is provided helically on the outer circumference of a center rod, the circular rod having opposite ends closed and being provided with discharge holes disposed at regular intervals. When a plating solution or air is discharged through the discharge holes by a pump in a state in which a corrugated tube is mounted on the circular rod, bubbles in the corrugated tube can be forcedly discharged. Accordingly, plating is stabilized without generation of any bubble standing, so that good coatings can be obtained.

In addition, in the plating method using the aforementioned plating jig, bubbles or plating solutions remaining in the corrugated tube are forcedly discharged by the pump so that the inverting operation of turning the plating jig upside down is not required. Accordingly, the apparatus can be adapted to automation.

What is claimed is:

1. A plating method using a plating jig, comprising the steps of:

inserting a corrugated tube having a slit formed in a lengthwise direction thereof onto a helical circular rod provided around the outer circumference of a center rod, said slit formed in the direction parallel to said helical circular rod;

putting said corrugated tube on said circular rod into a plating tank while holding the one end of said center rod and hanging said center rod vertically, so that said corrugated tube is plated with a plating material held in said plating tank;

changing a support position of said center rod in said plating tank from the one end to the other end; and taking said corrugated tube on said circular rod out of said plating tank while holding the other end of said center rod and hanging said center rod vertically after the corrugated tube has been plated.

2. A plating method, comprising the steps of:

inserting a corrugated tube having a slit formed in a lengthwise direction thereof onto a helical circular rod provided around an outer circumference of a center rod;

immersing said corrugated tube on said helical circular rod into a plating tank while holding one end of said center rod and hanging said center rod vertically; and discharging a plating solution into the inside of said corrugated tube through discharge holes formed in the outer circumference of said circular rod so that said corrugated tube is plated.

3. A plating method according to claim 2, further comprising the steps of:

pulling said corrugated tube on said circular rod out from said plating tank; and discharging air into the inside of said corrugated tube through said discharge holes formed in the outer circumference of said circular rod.

4. A plating method using a plating jig, comprising the steps of:

inserting a corrugated tube having a slit formed in a lengthwise direction thereof onto a helical circular rod while passing open rods through said slit, said open rods projecting outward from the outer circumference of said circular rod in the radial direction extending from the center of rotation of said helical circular rod;

putting said circular rod into a plating tank so that the center axis of said circular rod becomes horizontal; and rotating said circular rod with the center axis as the rotation center so that said corrugated tube contacts a plating material held in said plating tank.

* * * * *